US006539754B1

(12) United States Patent
Fang

(10) Patent No.: US 6,539,754 B1
(45) Date of Patent: Apr. 1, 2003

(54) FORCE-RESISTANT LOCK

(75) Inventor: Shih-Hao Fang, Taipei (TW)

(73) Assignee: Gee Bridge International Inc., Taipei (TW)

( * ) Notice: Subject to any disclaimer, the term of this patent is extended or adjusted under 35 U.S.C. 154(b) by 0 days.

(21) Appl. No.: 10/107,063

(22) Filed: Mar. 28, 2002

(51) Int. Cl.[7] ..... E05B 67/02

(52) U.S. Cl. ..... 70/52; 70/51; 70/54; 70/56; 70/DIG. 43; 70/417; 70/DIG. 56; 70/423

(58) Field of Search ..... 70/50–56, DIG. 43, 70/416, 417, 455, DIG. 56, 423

(56) References Cited

U.S. PATENT DOCUMENTS 2,352,190 A * 6/1944 Foote et al. ..... 29/437
2,379,437 A * 7/1945 Hines et al. ..... 70/38 A
3,453,758 A * 7/1969 Soref et al. ..... 40/665
3,848,440 A * 11/1974 Manuel ..... 70/55
3,858,419 A * 1/1975 Hampton ..... 70/55
3,952,560 A * 4/1976 Lee ..... 70/52
4,218,902 A * 8/1980 Druschel ..... 70/55
4,286,445 A * 9/1981 Sills ..... 70/55
4,297,861 A * 11/1981 Dykes ..... 70/55
4,317,344 A * 3/1982 Barnard ..... 70/55
4,651,543 A * 3/1987 Heald et al. ..... 70/54
5,033,279 A * 7/1991 Lebrecht ..... 70/55
5,761,935 A * 6/1998 Adelmeyer ..... 70/55
6,393,876 B1 * 5/2002 Matyko ..... 70/38 A
6,408,661 B1 * 6/2002 Chen ..... 70/33

* cited by examiner

*Primary Examiner*—Anthony Knight
*Assistant Examiner*—John B. Walsh
(74) *Attorney, Agent, or Firm*—Fei-Fei Chao; Venable, Baetjer, Howard & Civiletti, LLP

(57) ABSTRACT

A lock has a first steel plate having a first through hole defined to correspond to the core of the body, a circular cap movably received in the first through hole and having a slit defined to correspond to the keyhole of the core. A second steel plate is securely attached to the first steel plate and has a second through hole corresponding to the first through hole and bores corresponding to the holes of the first steel plate. A protection cap is securely attached to a bottom of the second steel plate and a distal edge of the protection cap is securely connected to an outer face of the body. The protection cap has an opening defined to correspond to the second through hole.

5 Claims, 6 Drawing Sheets

FORCE-RESISTANT LOCK

BACKGROUND OF THE INVENTION

1. Field of the Invention

The present invention relates to a lock, and more particularly to a demolishment-proof lock. The lock has a first steel plate and a second steel plate securely attached to the bottom of the lock, wherein the first steel plate has a first through hole and the second steel plate has a second through hole corresponding to and communicating with the first through hole. The second through hole has a diameter smaller than that of the first through hole so that a circular cap received in the first through hole is kept in the first through hole and between the first and second steel plates to prevent the core of the lock from being forcefully pulled out.

2. Description of Related Art

A conventional lock (5) as shown in FIG. 5 has rivets (51) protruding out from a bottom of the lock body (not numbered) and an exposed core (52). With this kind of structure, an unauthorized person may destroy the lock by damaging the rivets (51) or by forcefully pulling the core (52) out of the lock (5).

In order to obviate the opportunity for the unauthorized person to destroy the lock, an improved lock (6), as shown in FIG. 6, is invented. The lock (6) has a protection plate (61) securely attached to the bottom of the lock (6) and has a centrally-defined through hole (63) to correspond to the core (62) and bores (64) defined in a peripheral end face of the steel plate (61) to correspond to the rivets (60). With such an arrangement, the rivets (60) are concealed in the steel plate (61) so that deliberately damaging the rivets (60) is prevented. However, people still have access to the core (62), and consequently, the lock (60) may still be forced open.

To overcome the shortcomings, the present invention tends to provide an improved lock structure to mitigate and obviate the aforementioned problems.

SUMMARY OF THE INVENTION

The primary objective of the present invention is to provide an improved lock for prevention of destruction of the lock.

In order to accomplish the objective, the lock has a first steel plate and a second steel plate respectively and securely attached to the bottom of the lock. The first steel plate has a first through hole and the second steel plate has a second through hole corresponding to and communicating with the first through hole. The second through hole has a diameter smaller than that of the first through hole so that a circular cap received in the first through hole and having a slit defined to correspond to the keyhole of the core is kept in the first through hole and between the first and second steel plates to prevent the core of the lock from being forcibly removed.

Other objects, advantages and novel features of the invention will become more apparent from the following detailed description when taken in conjunction with the accompanying drawings.

DETAILED DESCRIPTION OF THE PREFERRED EMBODIMENT

Figure 1:
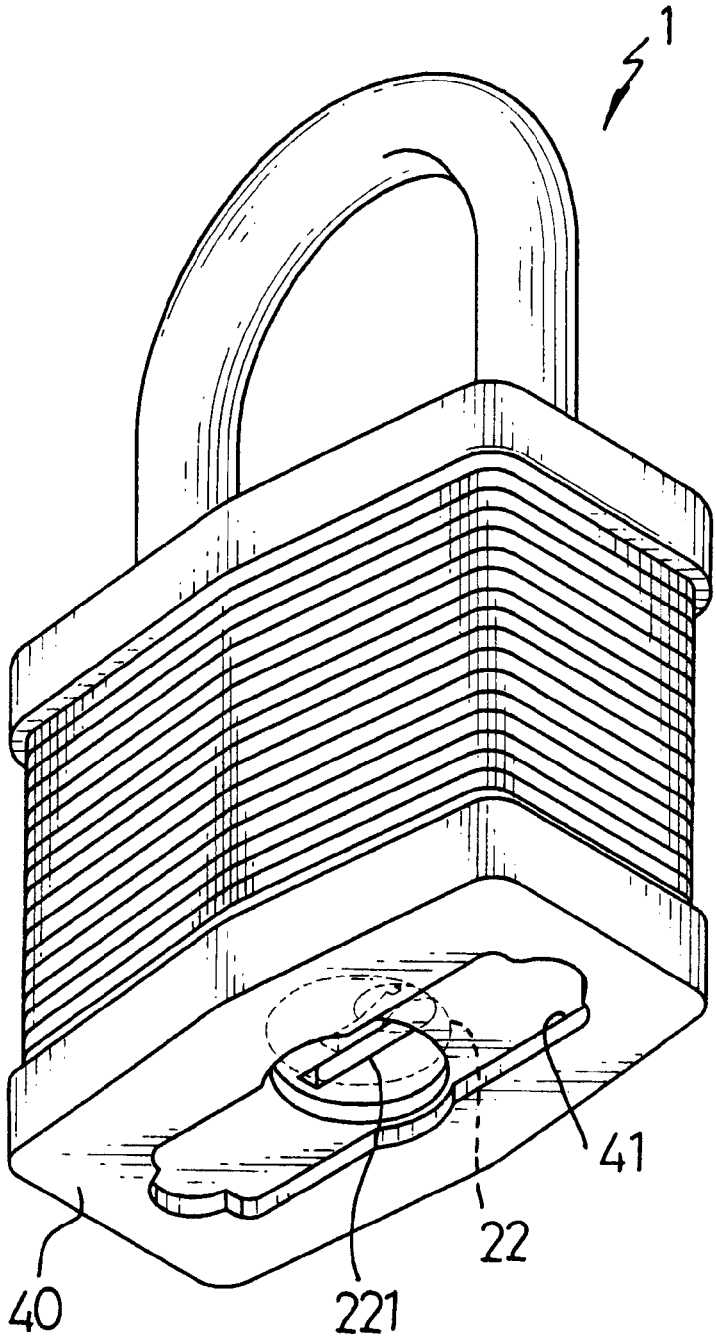
FIG. 1 is a perspective view of the lock of the present invention.
Figure 2:
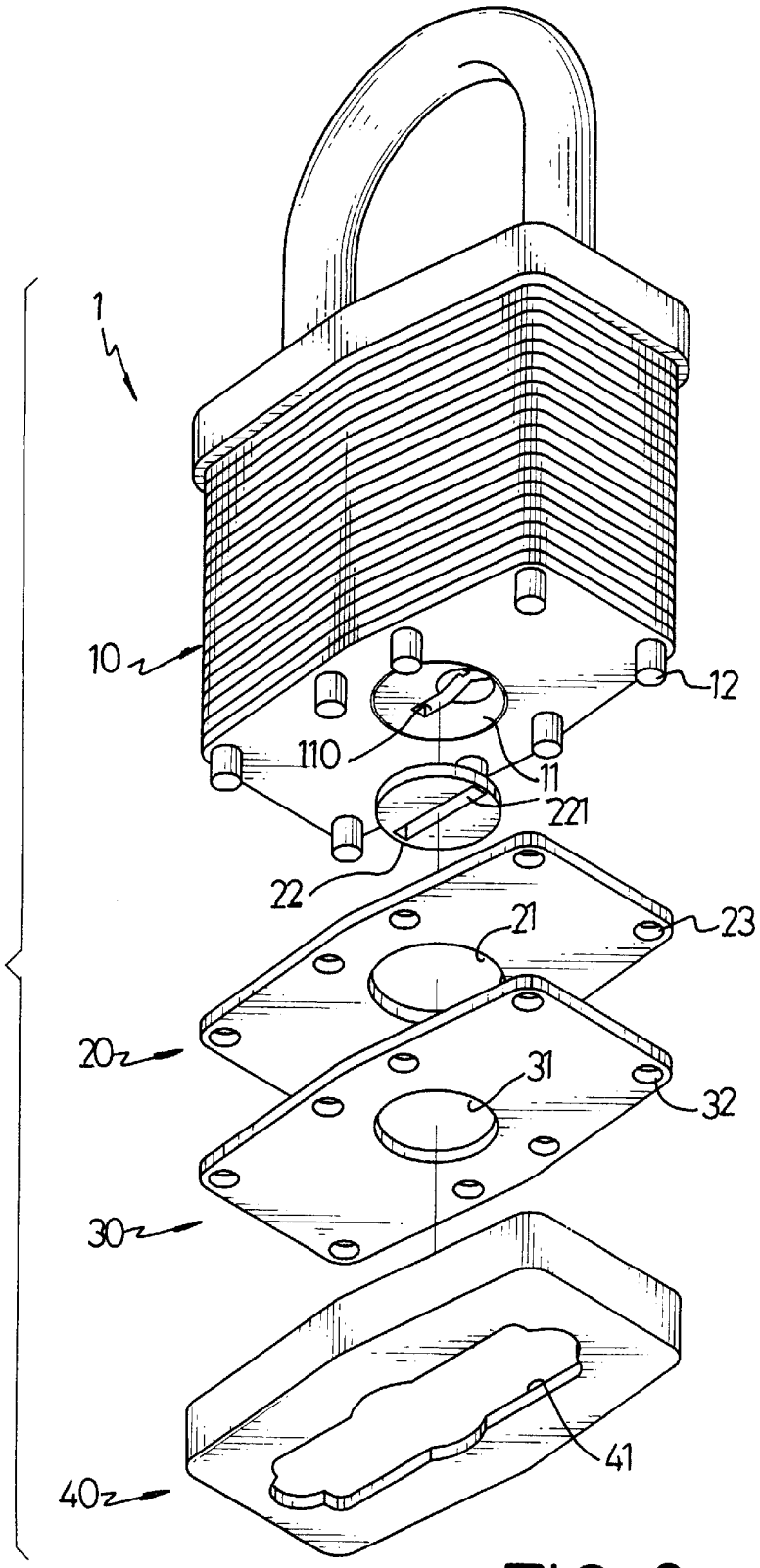
FIG. 2 is an exploded perspective view of the lock in FIG. 1.

With reference to FIGS. 1 and 2, the lock (1) in accordance with the present invention has a body (10), a first steel plate (20), a second steel plate (30) and a protection cap (40).

The body (10) has an exposed core (11) at a bottom of the body (10) and having a keyhole (110) defined therein and rivets (12) protruding out from the bottom of the body (10).

The first steel plate (20) has a first through hole (21) defined to correspond to the core (11) of the body (10), a circular cap (22) movably received in the first through hole (21) and having a slit (221) defined to correspond to the keyhole (110) of the core (11) and holes (23) defined to correspond to the rivets (12) of the body (10).

The second steel plate (30) has a second through hole (31) corresponding to the first through hole (21) and bores (32) corresponding to the holes (23) of the first steel plate (20).

The protection cap (40) has an opening (41) defined to correspond to the second through hole (31).

When the lock (1) of the present invention is to be assembled, the first steel plate (20) is securely attached to the bottom of the body (10) with the alignment between the core (11) and the first through hole (21) and each of the rivets (12) received in a corresponding one of the holes (23). Before securely attaching the second steel plate (30) to the first steel plate (20), the circular disk (22) is received in the first through hole (21). Because the diameter of the circular disk (22) is smaller than that of the first through hole (21) and the diameter of the second through hole (31) is smaller than that of the circular disk (22) so that the circular disk (22) is kept between the first and second steel plates (20,30). While the second steel plate (30) is attached to the first steel plate (20), the bores (32) correspond to the holes (23) of the first steel plate (20). Therefore, after the protection of the first and second steel plates (20,30), the rivets (12) are deeply concealed. Then, the protection cap (40) is securely attached to the bottom of the second steel plate (30) with the opening (41) corresponding to the second through hole (31).

Figure 3:
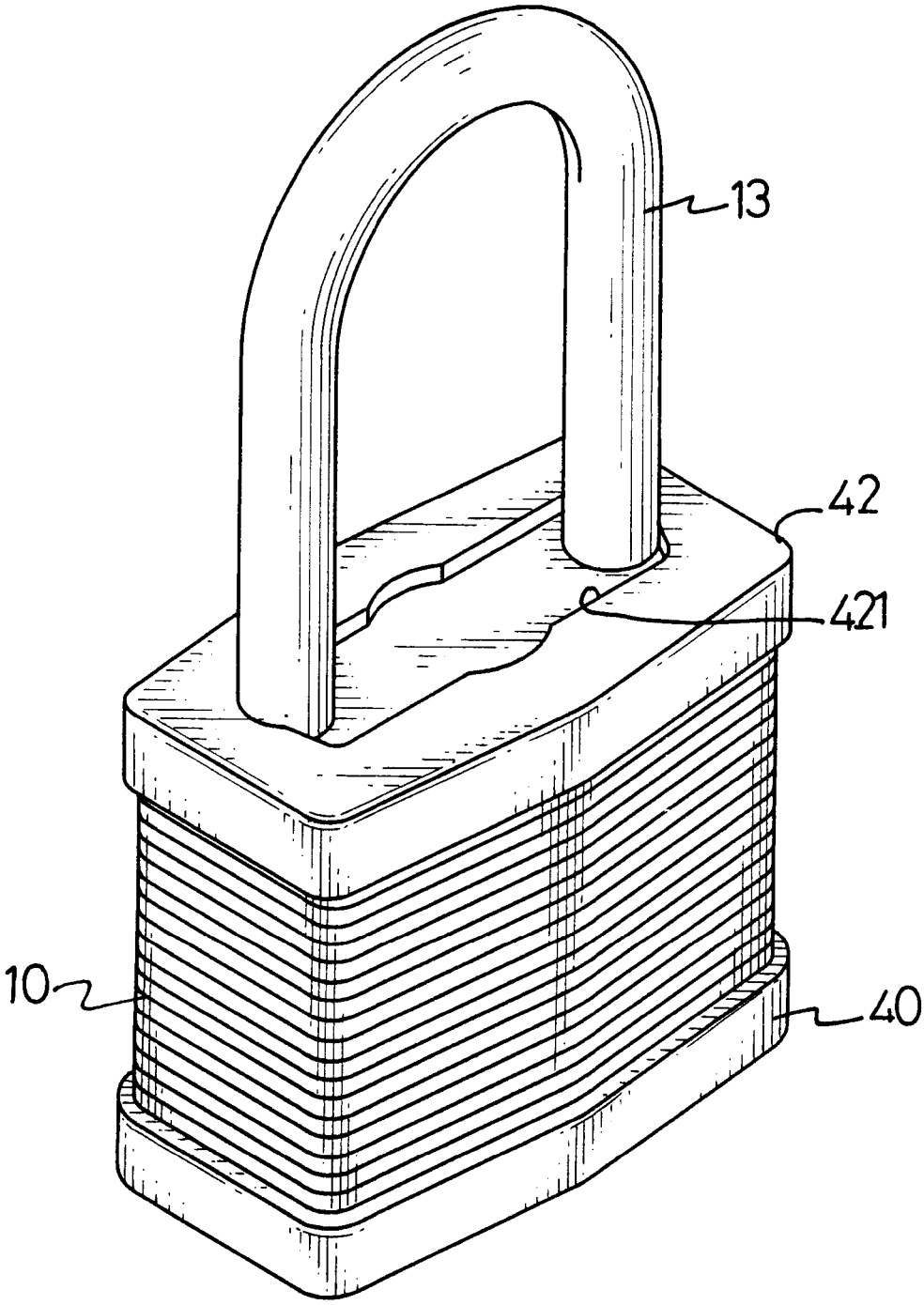
FIG. 3 is a perspective view of the lock with a secondary protection cap mounted on top of the lock.

With reference to FIG. 3, it is to be noted that when the protection cap (40) is attached to the bottom of the second steel plate (30), a distal edge of the protection cap (40) firmly engages with an outer face of the body (10) so that the first and second steel plates (20,30) are also enclosed inside the protection cap (40). In addition to the protection cap (40), a secondary protection cap (42) having a secondary opening (421) corresponding to the latch (13) which is connected to the body (10) is securely mounted on top of the body (10).

Figure 4:
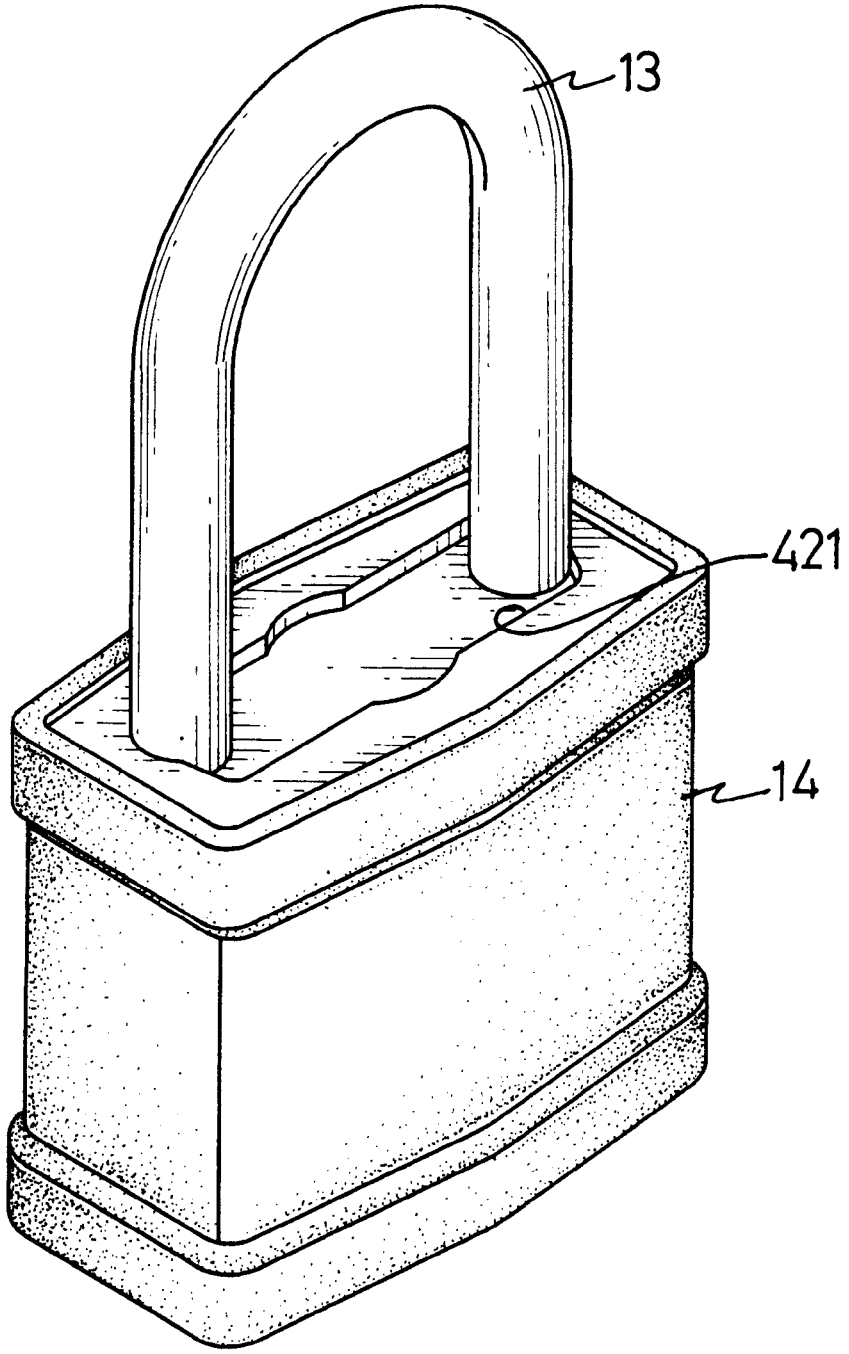
FIG. 4 is a perspective view of the lock with a rubber enclosure attached to the exterior of the lock.
Figure 5:
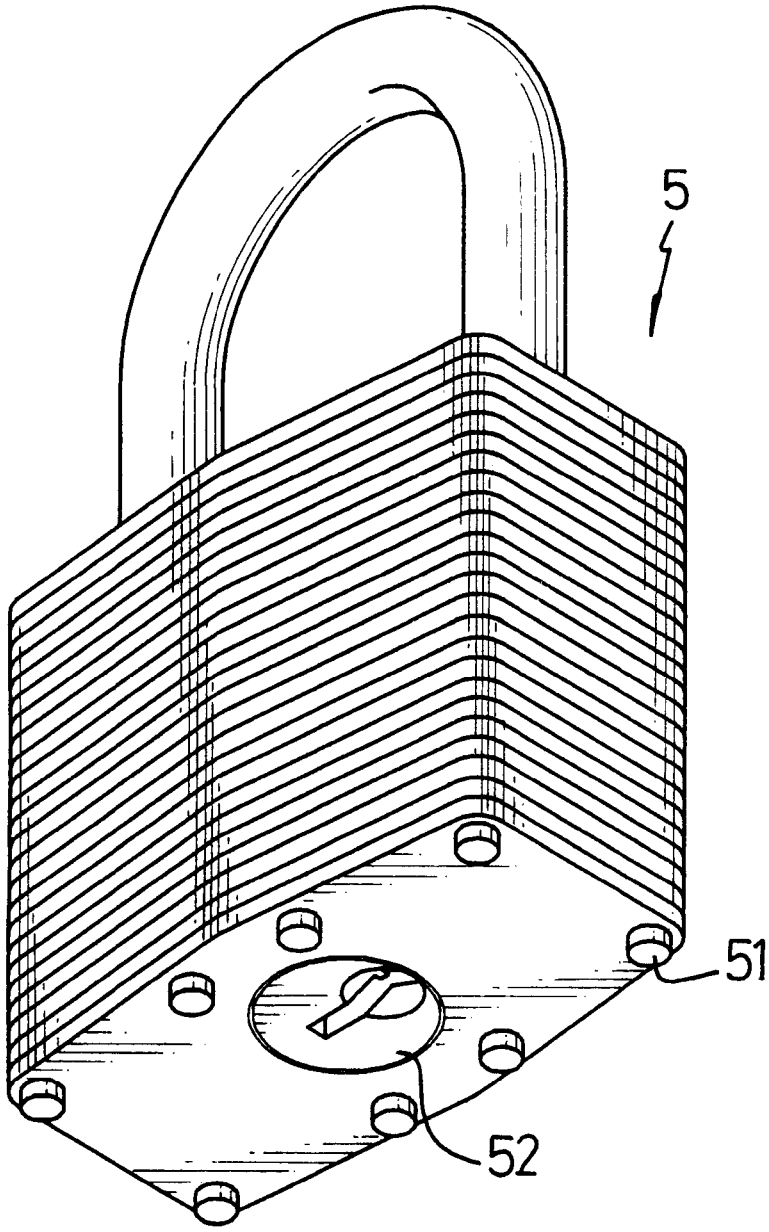
FIG. 5 PRIOR ART
FIG. 5 is a perspective view of a conventional lock.
Figure 6:
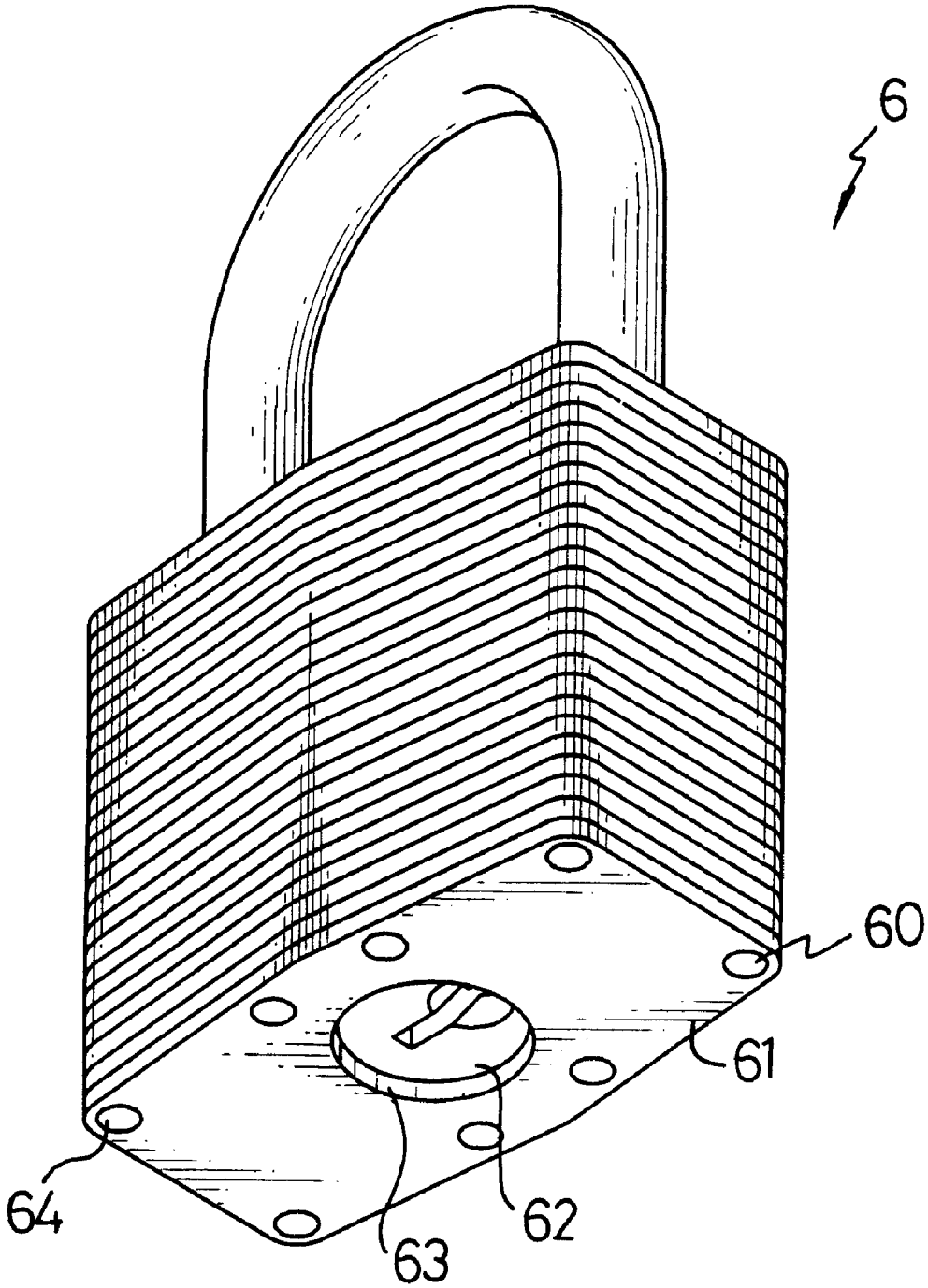
FIG. 6 PRIOR ART
FIG. 6 is a perspective view of another conventional lock.

With reference to FIG. 4, a rubber enclosure (14) is provided to detachably attached to the exterior of the lock (1) so as to enhance the appearance of the lock.

With the first, second steel plates (20,30), the protection cap (40) and the secondary protection cap (42), the lock (1) of the present invention is able to prevent any unauthorized persons to deliberately demolish the lock structure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a lock having a body with a core received therein and provided with a keyhole and a latch connected to the body, wherein the improvements comprise:

a first steel plate having a first through hole defined to correspond to the core of the body, and holes adapted to be defined to correspond to rivets of the body, a circular cap movably received in the first through hole and having a slit defined to correspond to the keyhole of the core;

a second steel plate securely attached to the first steel plate and having a second through hole corresponding to the first through hole and bores corresponding to the holes of the first steel plate;

a protection cap securely attached to a bottom of the second steel plate and a distal edge of the protection cap adapted to securely connect to an outer face of the body, the protection cap having an opening defined to correspond to the second through hole, whereby a structure of the lock is reinforced by the first, second steel plates and the protection cap.

2. The lock as claimed in claim 1, wherein the circular cap has a diameter smaller than a diameter of the first through hole so that the circular cap is able to be movably received in the first through hole.

3. The lock as claimed in claim 2, wherein the diameter of the circular cap is larger than a diameter of the second through hole so that the circular disk is kept between the first and second steel plates.

4. The lock as claimed in claim 3, wherein a secondary protection cap is adapted to be securely mounted on top of the body and having a secondary opening adapted to correspond to the latch of the body.

5. The lock as claimed in claim 4, wherein a rubber enclosure is adapted to be detachably mounted on the outer face of the body so as to enhance the appearance of the lock.

* * * * *